United States Patent [19]

Smith

[11] Patent Number: 4,901,976

[45] Date of Patent: Feb. 20, 1990

[54] FLOW CONTROL VALVE

[76] Inventor: Richard J. Smith, 4334-J Valley Ave., Pleasanton, Calif. 94566

[21] Appl. No.: 398,965

[22] Filed: Aug. 28, 1989

Related U.S. Application Data

[62] Division of Ser. No. 242,600, Sep. 12, 1988, Pat. No. 4,881,575.

[51] Int. Cl.[4] ..... F16K 3/26

[52] U.S. Cl. ..... 251/206; 251/325; 251/364; 251/900

[58] Field of Search ..... 251/206, 325, 364, 900

[56] References Cited

U.S. PATENT DOCUMENTS

| | | | |
|---|---|---|---|
| 1,679,219 | 7/1928 | Huff | 251/206 X |
| 2,628,809 | 2/1953 | Mikeska | 251/900 X |
| 2,788,244 | 4/1957 | Gilmour | 251/206 X |
| 3,294,112 | 12/1966 | Watkins | 251/206 X |
| 3,406,705 | 10/1968 | Meyer | 251/325 X |
| 4,134,573 | 5/1977 | Messinger | 251/900 X |
| 4,846,220 | 7/1989 | Rader | 251/206 X |

*Primary Examiner*—Robert G. Nilson
*Attorney, Agent, or Firm*—Linval B. Castle

[57] ABSTRACT

A fluid flow control valve for a fixture having a conduit for the passage of a fluid through the fixture comprises a valve rod that is manually slideable through a hole in the fixture to intercept the conduit at right angles. The rod has a plurality of various apertures through the diameter, each alignable with the conduit and sealed of by an O-ring around the rod to prevent leakage along the rod. In addition, novel saddle shaped O-rings closely surrounding the conduit and conforming to the arcuate surface of the valve rod prevent peripheral leakage around the surface of the valve rod in its "off" position.

4 Claims, 1 Drawing Sheet

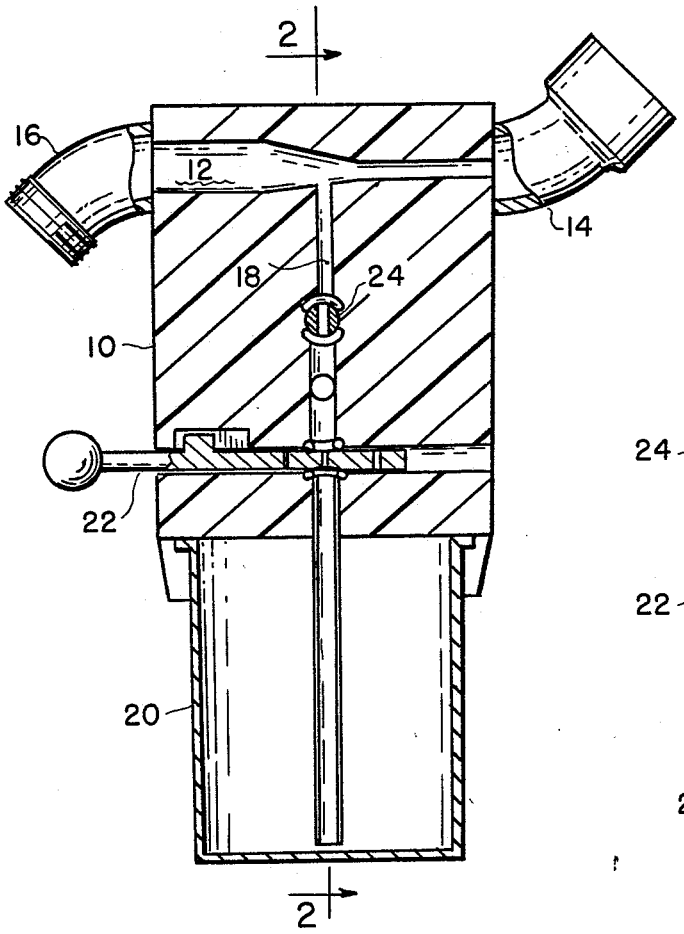
FIG. 1
FIG. 2
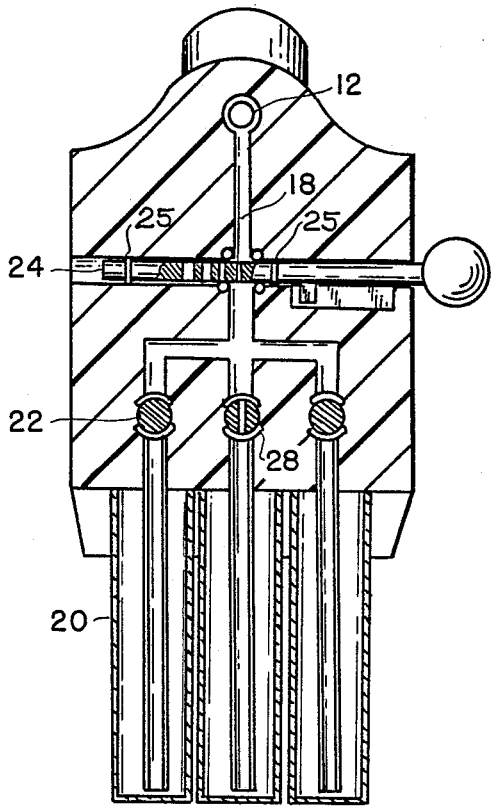
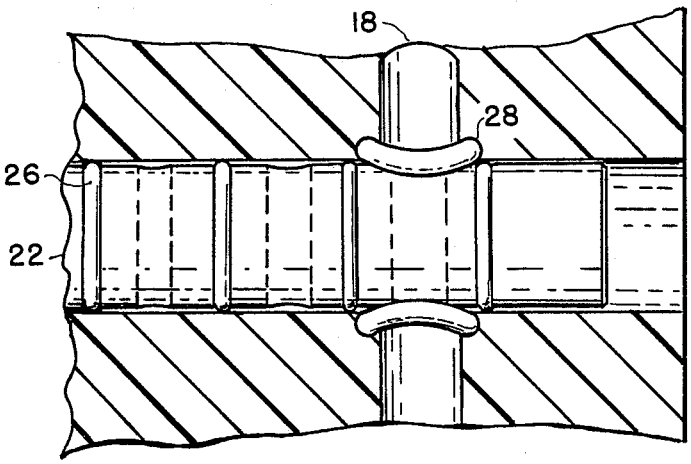
FIG. 4
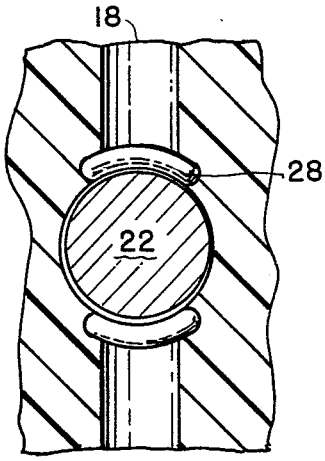
FIG. 3

FLOW CONTROL VALVE

CROSS REFERENCE TO RELATED APPLICATION

This application is a division of my co-pending patent application Ser. No. 07/242,600, filed Sept. 12, 1988 now U.S. Pat. No. 4,881,575.

BRIEF SUMMARY OF THE INVENTION

This invention relates to the control of fluid flow through a conduit and particularly to the flow control of one fluid being vacuum drawn by a Venturi into the flow of a second fluid.

The particular flow control valve to be described is the type employing a shaft having one or more diametrical holes of differing sizes. The shaft slides longitudinally through a housing in a hole that intersects, at right angles, a conduit connecting a fluid source with a vacuum pump such as a Venturi. By positioning the rod so that the desired diametrical hole is aligned with the conduit, the desired amount of a selected fluid is drawn through the hole toward the vacuum pump. Another typical use for such a slider flow regulator is in garden sprayers as shown in U.S. Pat. No. 2,788,244 to Gilmour.

The above related patent application also employs this type of flow regulation in a fixture that is designed to draw one or more fluids from three fluid containers and into a vacuum created by a Venturi in the water flowing between a water source and shower head. The advantage of using a slideable valve shaft instead of a more conventional rotary selection valve in the conduits from each of the three containers is that the user, temporarily blinded by shampoo or shower soap, can readily and quickly select, by touch, a desired slider rod and to adjust the desired flow position of that rod and hence the concentration of the selected fluid in the shower water.

Flow regulating valves employing a slider shaft should be thoroughly sealed with O-rings for proper operation. If a slider shaft has but one diametrical hole for on-off operation, the shaft should have an O-ring on both sides of the hole to prevent leakage around the peripheral surface of the rod. If there are several diametrical holes, it may be desired to install O-rings on each side of each hole for the same reason and also for preventing leakage between adjacent holes. In addition, it has been found that additional seals in the form of "saddle O-rings" are required at the intersection of the slideable valve shaft and the conduit to prevent circumferential leakage around the shaft, particularly when the valve is closed when no diametrical hole is aligned with the conduit.

BRIEF DESCRIPTION OF THE DRAWINGS

In the drawings which illustrate the preferred embodiment of the invention:

FIG. 1 is a sectional elevational view of a fluid dispenser for introducing selected fluids into a second fluid flow;

FIG. 2 is a sectional elevational view taken along the lines 2—2 of FIG. 1;

FIG. 3 is an enlarged detailed end view of a valve of FIG. 1; and

FIG. 4 is a detailed side elevational view thereof.

DETAILED DESCRIPTION OF THE PREFERRED EMBODIMENT

FIG. 1 is a sectional view of a shower head fluid dispenser 10 containing a Venturi 12 in a water flow line between a female pipe coupling 14 and a male shower head coupling 16. When water flows through the Venturi, a suction is developed in the conduit 18 which acts to draw fluid from one or more of the fluid reservoirs 20. The fluid may be a shampoo, liquid soap, body lotions or oils, or the like and one or more may be mixed into the shower water flow in a concentration as determined by the setting of selector valves 22 in line with each of the reservoirs 20 and a flow control valve 24 in the conduit, as best shown in FIG. 2.

As shown in FIGS. 1 and 2, the fluid selector valves 22 and flow control valve 24 are formed of rods slideable within a hole in the body of the fluid dispenser 10. Each rod has several diametrical holes of various diameters that are alignable with the conduits from the reservoirs 20 to the Venturi 12. Longitudinal adjustment of the valve rods with the holes in the dispenser body 10 thus regulates the flow of fluid between a preselected maximum to an "off" position, thus producing a convenient control system particularly for a user blinded by shampoo.

In the construction of a slideable rod type of valve such as described herein, the diameter of a rod must obviously be less than the hole through which it freely slides. This circumferential gap between the periphery of the rod and bore of the hole provides a fluid leakage path that requires at least one O-ring 25 at each end of the valve rod. To prevent leakage between adjacent longitudinal positions along the rod each position may also be isolated from adjacent positions by O-ring seals 26 seated in annular groves around the rod, as shown in the view of FIG. 4. This type of seal is well known and is used in valves in some types of hand-held personal shower heads that are concerned only with on-off control and not with fluid selections or the control of flow as with the valves 22 and 24.

O-ring seals such as the seals 26 around the selector valve rod 22 in FIG. 4 will prevent fluid in a conduit from being forced into adjacent longitudinal positions along the rod. It will not, however, prevent some leakage through the conduit when the selector valve rod is in an "off" position because fluid from a reservoir 20 can be drawn around the exterior surface between the closed valve rod and the bore of the hole though which the rod may slide. The result is that fluid will always be withdrawn from all reservoirs even when the valves are "off" and, in the absence of vacuum in the conduit 18, there will always be a gravity draining of fluids from the upper part of the conduit through closed selector valves to contaminate the remaining fluids.

To eliminate all peripheral or circumferential leakage of fluids and to prevent cross-contamination of fluids through closed valves, a "saddle O-ring" 28 is installed at the junction of each valve rod, such as the rod 22, and its conduit 18.

The saddle O-ring is a conventional circular O-ring that is deformed by pressing it into arcuate counterbores in the body 10 around the conduit 18 at each location where the conduit meets a rod, such as the rod 22. It confines all fluids within the conduit except the small amounts which may remain within a rod diametrical hole when the valve rod 22 is moved into another position and completely eliminates the circumferential or peripheral leakage between valve rod and the hole through which it slides.

Having thus described my invention, what is claimed follows:

1. In a fixture having a tubular conduit for the passage of a fluid, valve means for controlling the flow of the fluid comprising:

a valve rod having an arcuate surface, said rod longitudinally movable through a tubular hole through the fixture to intercept the conduit at substantially right angles;

at least one diametrical valving aperture through said valve rod, said aperture being alignable with said conduit;

a pair of O-rings in grooves around said valve rod, said grooves located on each side of said aperture to prevent fluid leakage between said conduit and the exterior of said fixture; and first and second saddle O-rings surrounding said conduit and conforming to the arcuate surface of said valve rod, said saddle O-rings positioned at the junction of said conduit with opposite arcuate surfaces of said valve rod.

2. The valve means claimed in claim 1 wherein said valve rod contains a plurality of diametrical valving apertures, said rod further containing at least one O-ring between the outermost of said plurality and the end of said rod for preventing fluid leakage from said fixture from between the surface of said rod and the wall of said tubular hole.

3. The valve means claimed in claim 2 wherein said valve rod contains a plurality of diametrical valving apertures, each separated by an O-ring for preventing fluid leakage between adjacent apertures.

4. The valve means claimed in claim 3 wherein said valve rod is manually adjustable through the tubular hole in the fixture.

* * * * *